United States Patent [19]

Sekiguchi

[11] 4,421,413

[45] Dec. 20, 1983

[54] APPARATUS FOR CONTINUOUSLY EMULSIFYING THE LIQUIDS

[75] Inventor: Hideo Sekiguchi, Maebashi, Japan

[73] Assignee: Sekiguchi Co., Ltd., Tokyo, Japan

[21] Appl. No.: 306,628

[22] Filed: Sep. 28, 1981

[51] Int. Cl.[3] ..... B01F 7/02

[52] U.S. Cl. ..... 366/307

[58] Field of Search ..... 366/305, 307, 325, 176

[56] References Cited

U.S. PATENT DOCUMENTS

| | | | |
|---|---|---|---|
| 1,807,773 | 6/1931 | Dawson | 366/176 |
| 3,183,099 | 5/1965 | Schultz et al. | 366/305 |
| 3,333,828 | 8/1967 | Boehme | 366/305 |
| 4,128,342 | 12/1978 | Renk | 366/305 |

*Primary Examiner*—Philip R. Coe
*Assistant Examiner*—Thomas W. Epting
*Attorney, Agent, or Firm*—Jordan and Hamburg

[57] ABSTRACT

An apparatus which can continuously produce highly-stable emulsified liquid is substantially characterized in that a casing is provided with a plurality of stators mounted on the inner surface of the casing and a plurality of agitator blade rotors which are concentrically and rotatably disposed relative to the stators and that several minute gaps are defined between the stators and rotors. By making at least two different kinds of liquid pass through such minute gaps from one end of the casing to the other, an emulsified liquid having high stability can be obtained from the other end without increasing flow resistance.

3 Claims, 5 Drawing Figures

APPARATUS FOR CONTINUOUSLY EMULSIFYING THE LIQUIDS

BACKGROUND OF INVENTION

This invention relates to a continuous emulsifying apparatus disposed in an oil supply line which forms a main unit of a system which produces emulsified fuel oil for combustion purposes.

Conventionally, there has been proposed several apparatuses for mixing at least two different kinds of liquids in the line. One of such apparatuses utilizes propeller-shaped agitator blades which rotate in a casing. However, the apparatus has not been commercially put into practice in the emulsification of fuel oil and water which have no affinity for each other, since the apparatus has the following defects.

(1) insufficient mechanical energy, (2) insufficient emulsification due to the short path.

For facilitating the understanding of the present invention, the difference between the mixing and the emulsifying is explained hereinafter.

In case at least two different kinds of liquids which have no affinity for each other are brought together to produce one liquid, the produced liquid which is the mixture of two liquids can have a uniform nature as time passes by. This phenomenon is called "mixing". The mechanical agitation is one of the means to shorten the time necessary for such mixing. The conventional mixing apparatus is used for such mechanical agitation.

However, when the two different kinds of liquids have no affinity for each other, they maintain the mixture condition so long as the agitation is continued but readily separate from each other as soon as the agitation is ceased.

In this case, when the agitation which is applied to the liquids as a mechanical force is greatly increased, the liquids are subjected to a shearing force, wherein one liquid is dispersed in the other liquid in the form of fine droplets thus providing a milky fluid, an emulsion and such state of emulsion continues for a certain period. The emulsion period becomes prolonged as the diameter of the fine droplets becomes smaller.

An emulsion which can maintain such prolonged emulsion period is referred to as "an emulsion having high stability".

In the combustion of emulsified liquid oil, an especially high emulsion is required, since the separation of the mixture or the emulsion into the respective liquids results in unstable combustion and in a worst case leads to shut off of the combustion.

Accordingly, it is an object of the present invention to provide a continuous emulsifying apparatus which can produce a highly-stable emulisified liquid by applying a sufficient mechanical force such as a high shearing force or impact force to the liquids to be emulsified in such a manner that the liquids are repeatedly forced to pass through a desired number of minute gaps defined between stators and rotors while preserving "the restriction of the increase of flow resistance" which is a prerequisite for mixing apparatuses in general.

The apparatus of this invention comprises a casing having at least two inlets for different kinds of liquids in one end thereof and an emulsified liquid outlet at other end thereof, a plurality of circumferential ribs formed on the inner wall of the casing in a spaced-apart manner in a longitudinal direction, a plurality of radially equidistant protrusions formed on the inner surface of the casing, each protrusion extending in a longitudinal direction and having the same inner diameter as those of the circumferential ribs, the protrusions crossing the circumferential ribs, thus providing a plurality of slits in the inner wall of the casing, and an impeller rotatably and concentrically disposed in the casing, the impeller consisting of a rotating shaft and a desired number of rows of radially-equidistant agitator blades mounted on the shaft, the agitator blades having an outer diameter slightly smaller than an inner diameter of the circumferential ribs thus providing the minute gaps between the blades and the ribs.

Due to the above construction, the liquids are alternately subject to the slits which try to stop the flow of liquids and the impeller which rotates at a high speed. This implies that the liquids are repeatedly forced to pass through the minute gaps provided between the protrusions of the stationary slits and the outer circular periphery of the impeller. During the above flow of the liquids passing through the gaps, the liquids are subject to mechanical force such as shearing and impact, whereby a highly stable emulsion is obtained.

DESCRIPTION OF THE PREFERRED EMBODIMENTS

The continuous emulsifying apparatus of this invention is hereinafter disclosed in detail in conjunction with the attached drawings.

Figure 1:
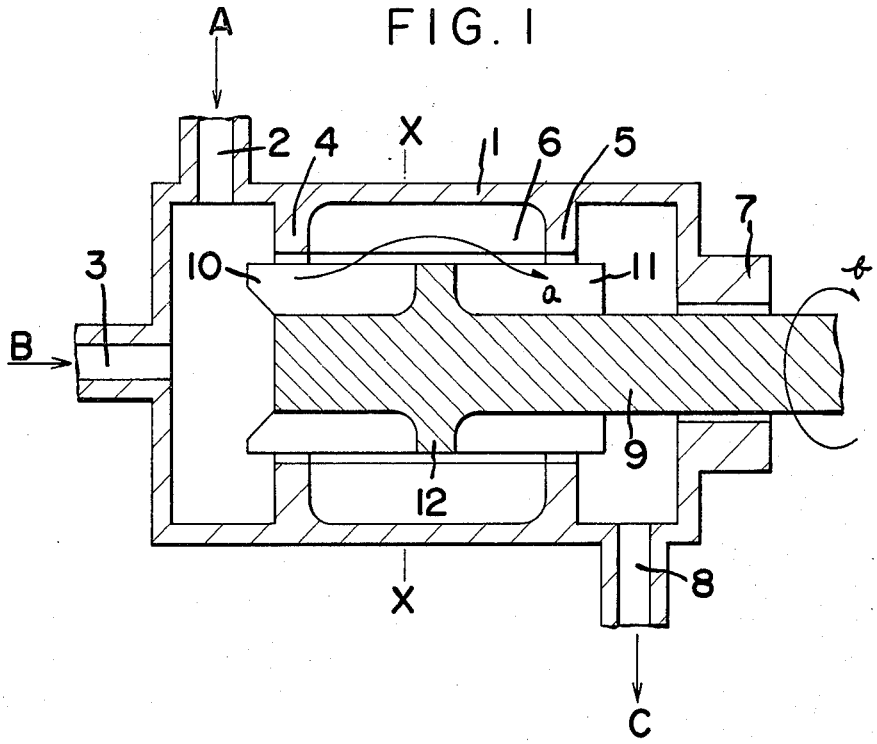
FIG. 1 is a schematic longitudinal cross sectional view of the apparatus of the present invention.

In FIG. 1, a casing 1 is provided with two inlet openings 2, 3 through which two different kinds of liquids (A) and (B) are fed into the casing 1. Two parallel-spaced-apart circumferential ribs 4, 5 are formed in the inner surface of the casing 1 at the inlet portion and the outlet portion respectively. A plurality of radially-equidistant slits 6 are formed in the inner surface of the casing between the inlet- and outlet-circumferential ribs 4 and 5. An elongated shaft 9 is concentrically disposed within the casing 1. The shaft 9 is integrally provided with a pair of groups of radially extending equidistant agitator blades 10, 11 on the outer surface thereof and these blades 10, 11 are separated by a circular disc 12 which has the same diameter as that of the agitator blades 10 and 11. An impeller is formed by the shaft 9, the blades 10 and 11 and circular disc 12. Furthermore, these agitator blades are constructed so as to protrude from the inlet- and outlet-circumferential ribs 4, 5 respectively. The casing 1 is also provided with an emulsified-liquid outlet 8 and a bearing 7 which rotatably and sealingly supports the shaft 9 in the casing 1.

In the drawing, the arrow (a) shows the flow direction of the liquids and the arrow (b) shows the rotating direction of the shaft 9.

Figure 2:
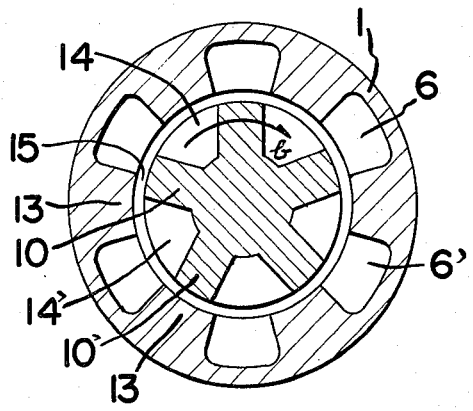
FIG. 2 is a transverse cross sectional view of the apparatus taken along the line X—X of FIG. 1.

As can be understood from FIG. 2, the inner diameter of the protrusions 13, 13' of the slits 6, 6' is equal to the inner diameter of the circumferential ribs 4 and 5. Radial spaces 14, 14' formed between each two agitator blades 10, 10 and 10', 10' define the liquid flow passages. Minute gaps 15 are formed between the outer peripheries of the agitator blades 10, 11 and the inner peripheries of the protrusions 13. The number of slits 6, 6' and the number of the agitator blades 10, 10' differ so as to avoid the concentration of force in one specific direction.

The manner in which the above continuous emulsifying apparatus is operated is hereinafter disclosed in conjunction with the attached drawings.

Since the casing 1 is always filled with liquids, the liquid fed into the casing 1 from the inlets 2 and 3, irrespective of the rotation of the impeller, flow in the casing 1 in the direction of the arrow (a) and liquid which has an amount equal to the amount fed into the casing 1 through the inlet 2, 3 is discharged from the outlet 8. In this flow of the liquids, the flow resistance can be restricted as low as possible by suitably selecting the total cross-sectional area of the slits 6, 6' and the impeller spaces 14, 14'.

Figure 3:
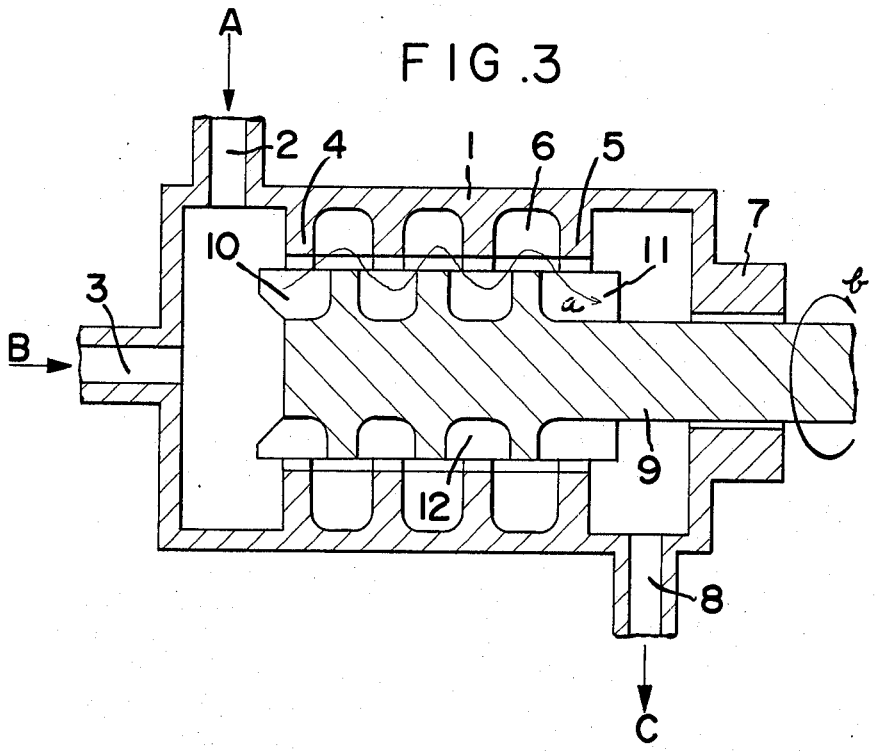
FIG. 3 is a schematic longitudinal cross sectional view of a modification of the apparatus.

When the impeller is driven at a high rotating speed, two liquids (A), (B) are fed into the impeller spaces 14, 14' in a pre-mixed condition. Since the smooth axial flow of the pre-mixed liquids is prevented by the circular disc 12, when the liquids are to proceed into the slits 6, 6', the liquids are subject to a mechanical force such as the shearing force or the impact between the stationary protrusions 13, 13' and the rotating agitator blades 10, 10'. Furthermore, in the minute gaps 15, the liquids are also subject to an abrading action. Due to the above actions, one of the liquids, (A) or (B) is dispersed in the other liquid in the form of fine droplets, thus providing an emulsion. Such actions are also repeated when the liquids now emulsified is fed into the spaces formed between each two agitator blades 11, 11' from the slits 6, 6', whereby the stability of the emulsified condition is further enhanced. The extent of such emulsification can be easily increased by increasing the number of the circumferential ribs of the casing and of the circular discs 12 of the impeller. Therefore, so called "short path" which means the flow-out of liquids with insufficient emulsification can be prevented, thus enabling the production of highly-stable emulsified liquid. Such modification is shown in FIG. 3.

As has been described heretofore, since the emulsifying apparatus of the present invention hardly increases the flow resistance, the apparatus does not necessitate a specially-devised pump and can be readily utilized in a line system already built so as to continuously conduct emusification of the liquids.

Furthermore, according to this invention, the two liquids such as a fuel oil and water which have no affinity for each other can be easily converted into a highly-stable emulsified fuel oil. In combustion of such emulsified fuel oil, when the oil is sprayed into a furnace, the fine droplets dispersed in the oil crush the oil droplets in the sprayed oil by exploding evaporation thereof thus greatly increasing the contact area of the oil droplets providing the following advantages in terms of energy saving and the protection of air pollution.

(a) complete combustion (b) prevention of soot (c) decrease of nitrogen oxide

Figure 4:
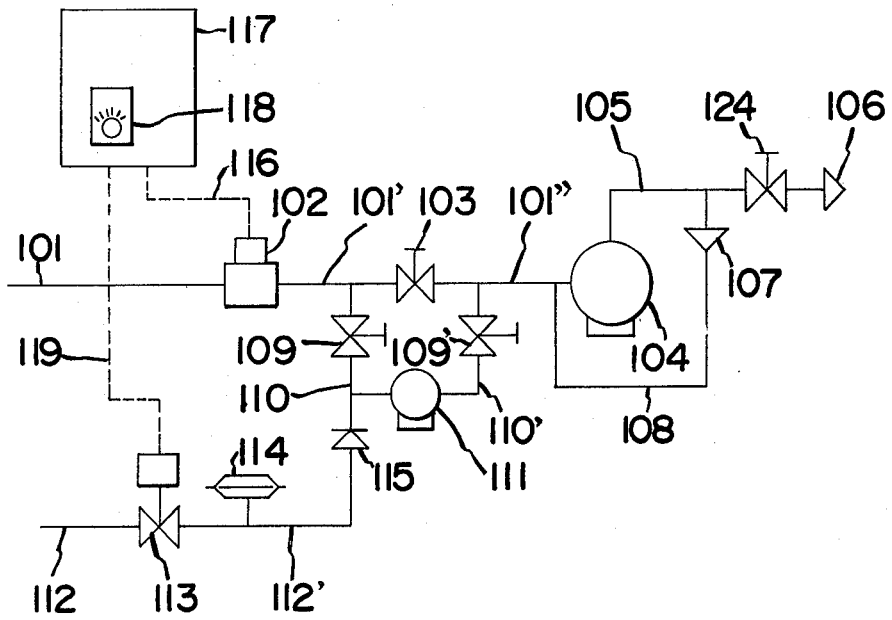
FIG. 4 is a flow chart of an emulsified fuel oil producing system in which the above apparatus is incorporated.
Figure 5:
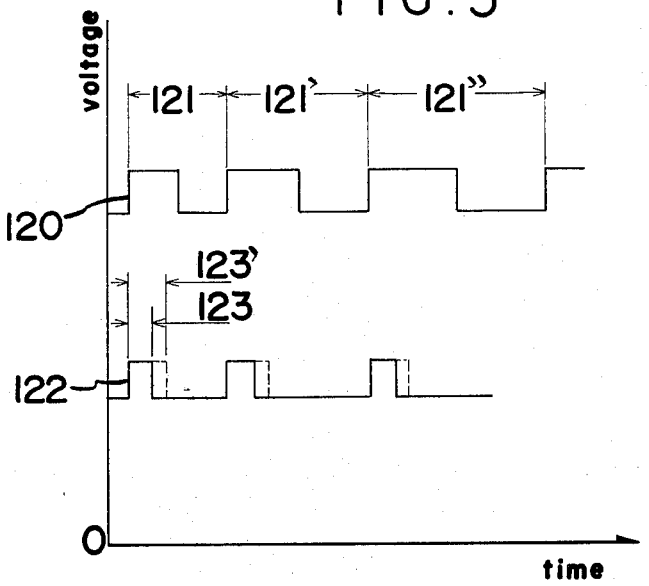
FIG. 5 is a graph showing the manner of regulating the amount of water to be mixed to the fuel oil.

In FIG. 4 and FIG. 5, a system for producing the emulsified fuel oil is shown, wherein the above mentioned continuous emulsifying apparatus is incorporated as a unit or a part thereof.

In FIG. 4, the fuel oil preliminary heated to a predetermined temperature in an oil tank (T) is fed into a oil supply pump 104 by way of an oil supply line 101, a pulse-generating flow meter 102, an oil supply line 101', a stop valve 103 and an oil supply line 101''. Subsequently, the fuel oil is pressurized by the oil supply pump 104 and is sprayed into a furnace by a burner 106 attached to the distal end of an oil supply line 105. The amount of fuel oil to be sprayed is regulated by a throttle valve 124 corresponding to the load in the furnace. The excessive fuel oil returns to the oil supply pump 104 by way of a relief valve 107 and return oil line 108.

When the stop valve 103 is closed and bypass stop valves 109, 109' are opened, the fuel oil flows to the oil supply line 101'' by way of the bypass lines 110, 110'' and an emulsifying mixer 111 which forms the continuous emulsifying apparatus of the present invention discussed heretofore. The supply water which is predetermined to have a pressure which is higher than the oil pressure in the oil supply line 101 flows into a solenoid valve 113 by way of a water supply line 112, and the flow thereof is regulated by the solenoid valve 113. The water flow is then rectified by an accumulator 114 and flows into bypass line 110 by way of a water supply line 112' and a check valve 115 and merges with the fuel oil. The pulses generated from the flow meter 102 are transmitted to a control panel 117 by way of an electric wire 116 and the number of the pulses are counted by the control panel 117. An electric signal which is regulated so as to be generated after each predetermined number of received pulses from the flow meter 102 is transmitted to the solenoid valve 113 by way of an electric wire 119 so as to close or open the valve 113.

In FIG. 5, a graph is shown where voltage is taken as the coordinate and time is taken as the abscissa.

In the graph, a wave form 120 indicates pulses generated by the flow meter 102 and an interval 121 indicates a unit amount of oil. When the amount of flow does not vary, the interval is the same length, while when the amount of flow varies, such varying of the flow amount is indicated as the varying of the intervals 121', 121''. A wave form 122 indicates the electric signal to actuate the solenoid valve 113, wherein when the wave form is at a high level, the valve 113 is opened and vice versa. The number of opening or closing of the solenoid valve 113 is in proportion to the number of pulses transmitted from the flow meter 102 and the open time of the solenoid valve 113 can be restricted by a timer 118 (the pulse width 123 of the graph in FIG. 5), the amount of water to be mixed per unit of oil can be made constant. By adjusting the timer 118 so as to vary the open time of the solenoid valve 113 (indicated by the pulse width 123' of the graph in FIG. 5), the amount of water can be adjusted so that the emulsified fuel oil having a desired emulsion ratio can be obtained.

The manner in which the above emulsified fuel producing system is operated is hereinafter disclosed.

In the combustion of ordinary oil, the stop valve 103 is opened and bypass valves 9, 9' are closed. The flow meter 102 generates no pulses and merely accounts for the amount of fuel oil fed to the burner. To change the above system suitable for the combustion of the emulsified fuel oil, the stop valve 3 is closed and the bypass valves 9, 9' are opened, while the emulsifying mixer 111 is actuated so as to give signals to the control panel 117. All such operations for changing the system may be readily conducted by a electro-magnetic system.

After completion of the above system change, the control panel 117 which receives the pulses transmitted from the flow meter 2 transmit timer-regulated signals after each predetermined number of such pulses to the solenoid valve 113 so as to open or close the solenoid valve 113, wherein the amount of water to be mixed is in proportion to the fuel oil supplied to the burner. The mixing ratio of the water relative to the fuel oil can be readily adjusted to a predetermined value by the timer 118. The flow of water pumped out from the solenoid valve 113 intermittently is rectified into the smooth water flow by the accumulator 115.

Subsequently the smooth water flow is supplied to the bypass line 116 by way of the check valve 114 where the water merges with the fuel oil. The merged flow is converted into the emulsified fluid oil in a manner as previously described. The emulsified fuel oil is then pressurized by the oil supply pump 104 and is sprayed into the furnace by the burner 106.

What we claim is:

1. Apparatus for continuously emulsifying water and fuel oil comprising a casing having inlets for water and fuel oil in one end thereof and an emulsified fuel outlet at the other end thereof, a plurality of circumferential ribs formed on the inner wall of said casing longitudinally spaced from one another, a plurality of radially equidistant protrusions formed on the inner surface of said casing, each of said protrusions extending in a longitudinal direction and having the same inner diameter as that of said circmferential ribs, said protrusions intersecting said circumferential ribs to thereby provide a plurality of deep slits in said inner wall of said casing, and an impeller rotatably and concentrically disposed in said casing, said impeller consisting of a rotating shaft and at least a first and second plurality of circumferentially spaced-apart agitator blades mounted on said rotating shaft forming a deep impeller space between each two blades, said first plurality of agitator blades being longitudinally spaced from said second plurality of agitator blades, said agitator blades having an outer diameter slightly smaller than the inner diameter of said circumferential ribs thus providing gaps between said blades and said ribs, said impeller having at least one disc element disposed between said first and said second plurality of agitator blades, said disc element having an outer diameter corresponding to the outer diameter of said agitator blades, said disc element having a radial length substantially equal to the radial length of said agitator blades, said disc element having a longitudinal width less than the longitudinal length of said deep slits on said casing, whereby liquid passes between said deep impeller space in said impeller and said deep slits in said casing in a generally zigzag manner without increasing the flow resistance of the liquid passing therethrough.

2. Apparatus according to claim 1, wherein each of said deep slits in said casing has a longitudinal length substantially constant throughout the radial length thereof, each of said disc elements having a longitudinal width substantially constant throughout the radial length thereof, said longitudinal width of each of said disc element being less than said longitudinal length of said deep slits, said disc element being disposed substantially midway between two ribs such that longitudinal spaces are provided between said two ribs and said disc element disposed therebetween, said longitudinal spaces being of a substantially constant longitudinal width and having an overall radial length equal to the sum of the radial length of said agitator blades and said ribs, whereby said spaces provide a flow path for effecting emulsification without increasing the flow resistance of the liquid passing therethrough.

3. Apparatus according to claim 2, wherein said casing has an inlet chamber and an outlet chamber, said agitator blades extending longitudinally beyond the end ribs into said inlet chamber and into said outlet chamber, respectively.

* * * * *